US005114489A

United States Patent [19]

Milner et al.

[11] Patent Number: 5,114,489

[45] Date of Patent: May 19, 1992

[54] MEANS FOR PRODUCING A HIGH BRIX SUGAR LIQUID

[75] Inventors: Ted D. Milner, Westminster; Robert V. Zimmerman, Denver, both of Colo.

[73] Assignee: Silver Engineering Works, Inc., Aurora, Colo.

[21] Appl. No.: 619,645

[22] Filed: Nov. 29, 1990

[51] Int. Cl.[5] ..... C13F 1/06

[52] U.S. Cl. ..... 127/2; 127/19; 127/56; 210/360.1; 210/370.1; 210/369

[58] Field of Search ..... 127/19, 56; 210/360.1, 210/380.1, 369

[56] References Cited

U.S. PATENT DOCUMENTS 2,452,207 2/1944 Olcott ..... 127/56
2,883,054 4/1959 Sanchez ..... 127/19
3,226,257 12/1965 Steele et al. ..... 127/19
3,730,769 5/1973 Fiedler ..... 127/56

*Primary Examiner*—John Niebling
*Assistant Examiner*—P. L. Hailey
*Attorney, Agent, or Firm*—Walter C. Vliet; Bernard J. Murphy

[57] ABSTRACT

An annular compartment is disposed below the mixing ring of a rotating-basket, massecuite-separating centrifuge, to receive the magma therein. Eductors arrayed in the compartment receive hot water, and ingest magma, to eject the mix therethrough and to centrifuge the mix, while melting the sugar crystals in the magma. The melted crystals, now high brix sugar liquid, is overflowed into a companion compartment; from thence the liquid is passed over a weir, into a sub-compartment, for subsequent discharge.

13 Claims, 3 Drawing Sheets

MEANS FOR PRODUCING A HIGH BRIX SUGAR LIQUID

BACKGROUND OF THE INVENTION

This invention pertains, generally, to rotating-basket, massecuite-separating centrifuges, and in particular to means for use with such a centrifuge for producing a high brix sugar liquid from massecuite.

Massecuite-separating centrifuges are well known in the prior art, and exemplary thereof is U.S. Pat. No. 4,052,304, issued Oct. 4, 1977, to Mathieu J. Vertenstein. The same, aforesaid patent is incorporated herein by reference for a general understanding of such centrifuges.

It is an object of this invention to set forth high brix sugar liquid-producing means of novel efficiency in that the same enables the user thereof to produce the liquid without sugar crystal carry-over. The invention is drawn to the reduction of all sugar crystals to liquid form.

SUMMARY OF THE INVENTION

Particularly, it is an object of this invention to disclose, for use with a rotating-basket, massecuite-separating centrifuge, which centrifuge has a magma mixing ring, means for producing a high brix sugar liquid, said means comprising first means, for disposition thereof below the mixing ring of the centrifuge, for receiving therein magma from said ring; second means, coupled to said first means, for (a) agitating the magma received from said ring, and (b) melting sugar crystals, in the received magma, to a high brix sugar liquid; third means, coupled to said first means, for receiving therein such high brix sugar liquid from said first means; and means for discharging the sugar liquid from said third means.

BRIEF DESCRIPTION OF THE DRAWING FIGURES

Further objects of this invention, as well as the novel features thereof, will become apparent by reference to the following description, taken in conjunction with the acompanying figures, in which.

DETAILED DESCRIPTION

Figure 1:
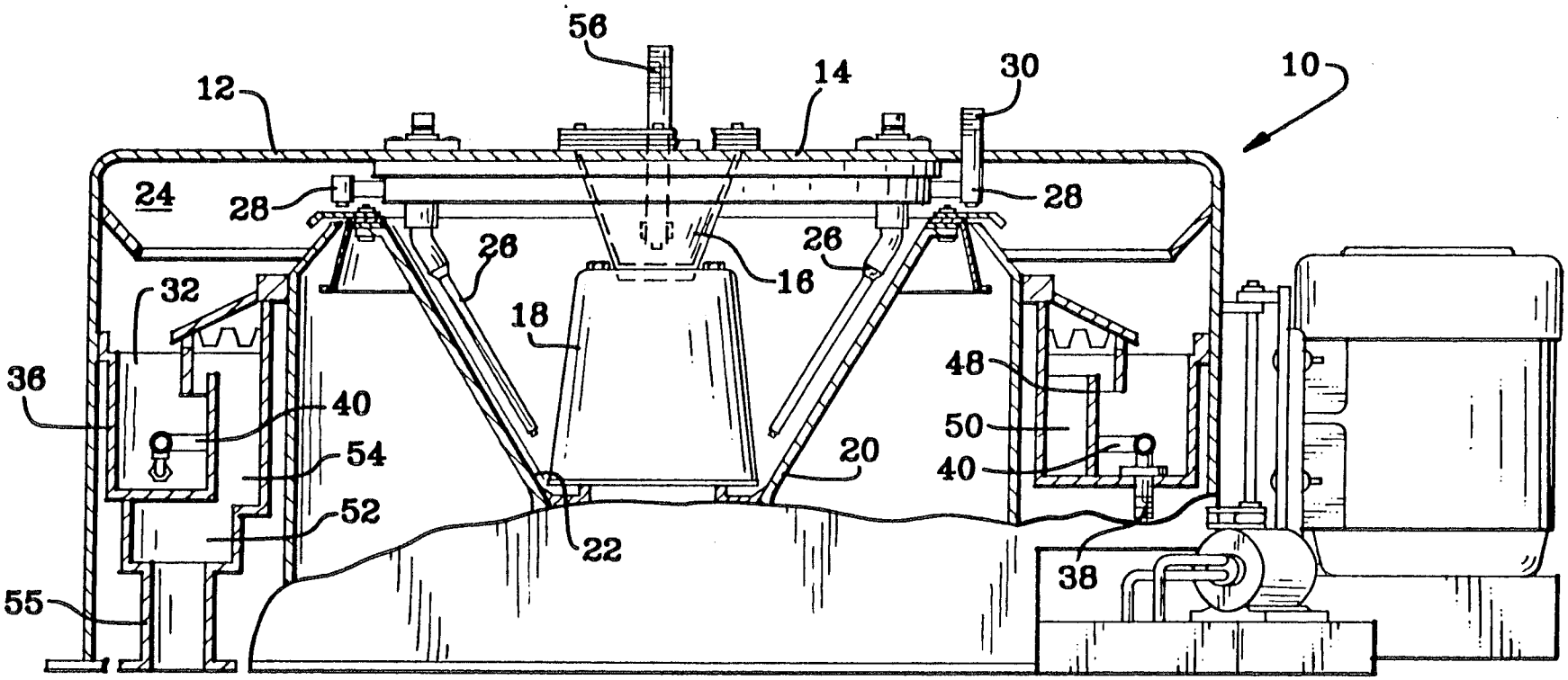
FIG. 1 is an illustration, partly cross-sectioned, of a rotating-basket, massecuite-separating centrifuge, having a magma mixing ring, in which the novel high brix sugar liquid-producing means has been incorporated via an embodiment thereof.

As shown in FIG. 1, a rotating-basket, massecuite-separating centrifuge 10 comprises a housing 12 having an upper cover sheet 14 with a central opening in which a nested pair of massecuite-admitting cones 16 are fixed. The cones 16 open into the accelerator bell 18. Coupled to, and set about the bell 18 is the rotating basket 20. The centrifuge operates in the usual, known manner to separate sugar crystals from molasses; the molasses passes through a screen 22 carried by the basket 20, and the sugar crystals travel up the screen 22 to the top of the basket 20. From there, the sugar crystals pass into the magma ring 24. Lances 26 provide a wash spray to assist in the separation of the molasses from the sugar crystals. All the aforesaid structure is known from the prior art.

At the top of the centrifuge 10, between the basket 20 and the magma ring 24, are arranged mixing liquid nozzles 28. The latter are supplied with hot water, of approximately one hundred and fifty degrees F., by a conduit 30 which exits the top of the centrifuge. This hot water, the mixing liquid, and the sugar crystals pass into the magma ring 24 as magma.

Figure 2:
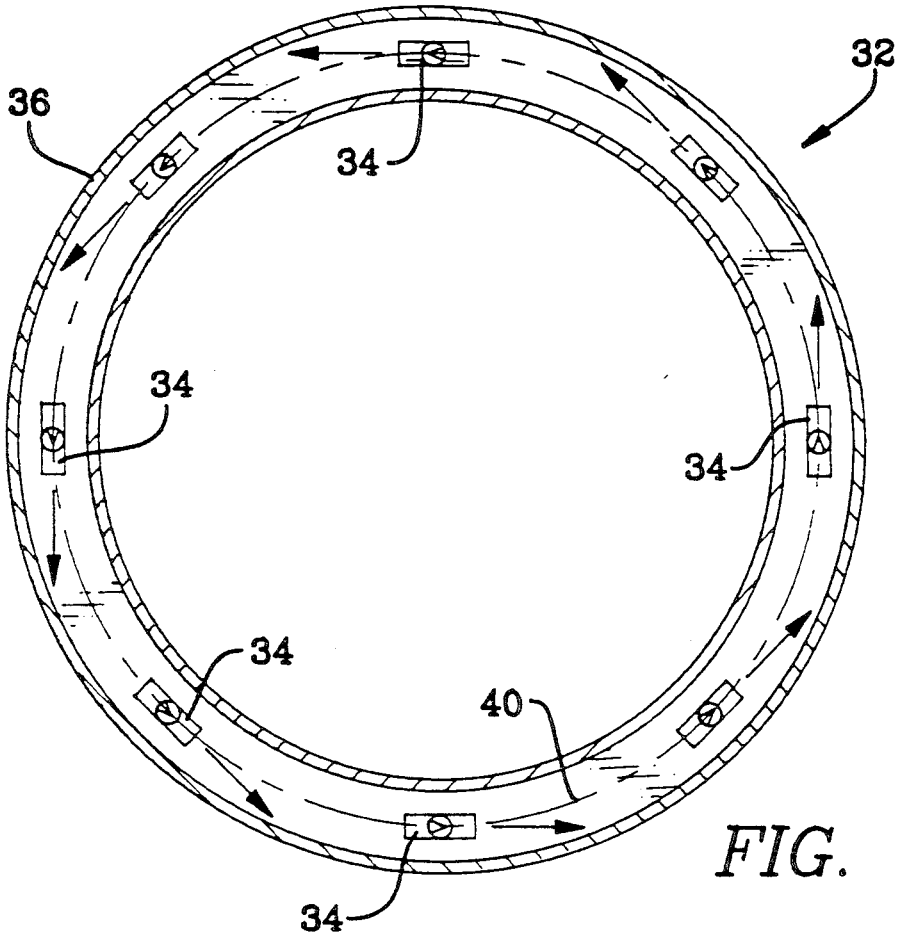
FIG. 2 is an out-of-scale representation of the eductors arrayed in the magma-receiving first compartment.
Figure 3:
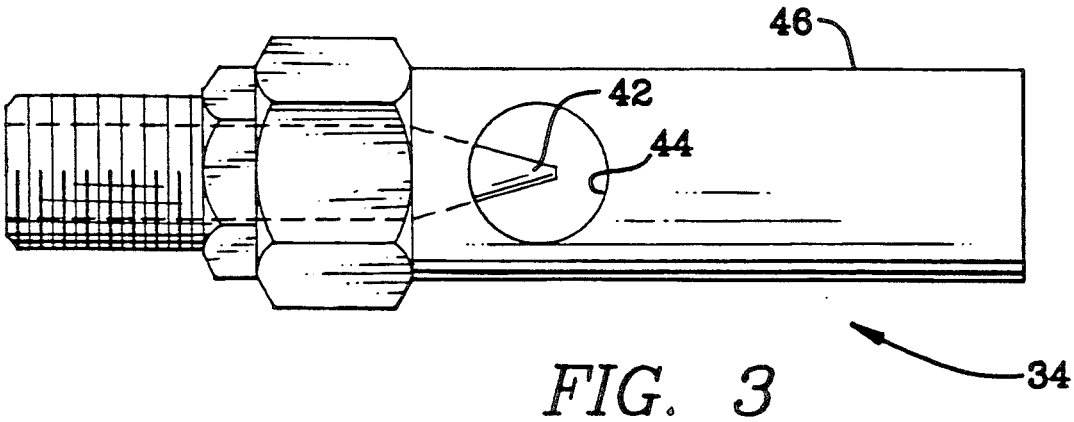
FIG. 3 is an enlarged, plan view of one of the eductors.

Disposed below the magma ring 24, and external of and circumjacent the rotating basket 20, is an annular compartment 32. It receives the magma from the ring 24 for heating and circulation thereof. Compartment 32 has a plurality of eductors 34 (eight in this embodiment) fixed therein, as shown in the FIG. 2 representation. The compartment 32 has an outermost wall 36 and, as represented, the eductors are directed to expel toward the wall 36. A conduit 38 supplies hot water, at approximately one hundred and ninety degrees F., to an annular manifold 40, and the latter conducts the hot water to each of the eductors 34. The eductors 34, one thereof shown enlarged in FIG. 3, each have a nozzle 42 which is centrally bored to pass the hot water therethrough, and a pair of opposed openings 44 to ingest magma and disperse the same with the throughput hot water out of the centrally-bored body 46 of the eductor (the bore not being shown). The eductors 34 set up circular and centrifugal motion of the magma in the compartment, and the hot water causes the sugar crystals in the magma to melt. The circular and centrifugal motion causes the unmelted crystals to move outwardly, toward the wall 36, while the melted, sugar liquid will overflow an inner wall 48 to enter a second, annular compartment 50. The inner compartment 50 gathers the, now, high brix sugar liquid and conducts it to a sub-compartment 52. The outlet from compartment 50 to the sub-compartment 52 has a weir 54 interposed therebetween. The weir retards the exiting of the sugar liquid from the second compartment 50 against the possibility that there still obtain unmelted sugar crystals therein. The delayed exiting of the liquid permits such crystals to melt before enter the sub-compartment 52. A discharge conduit 55 carries off the sugar liquid.

Figure 4:
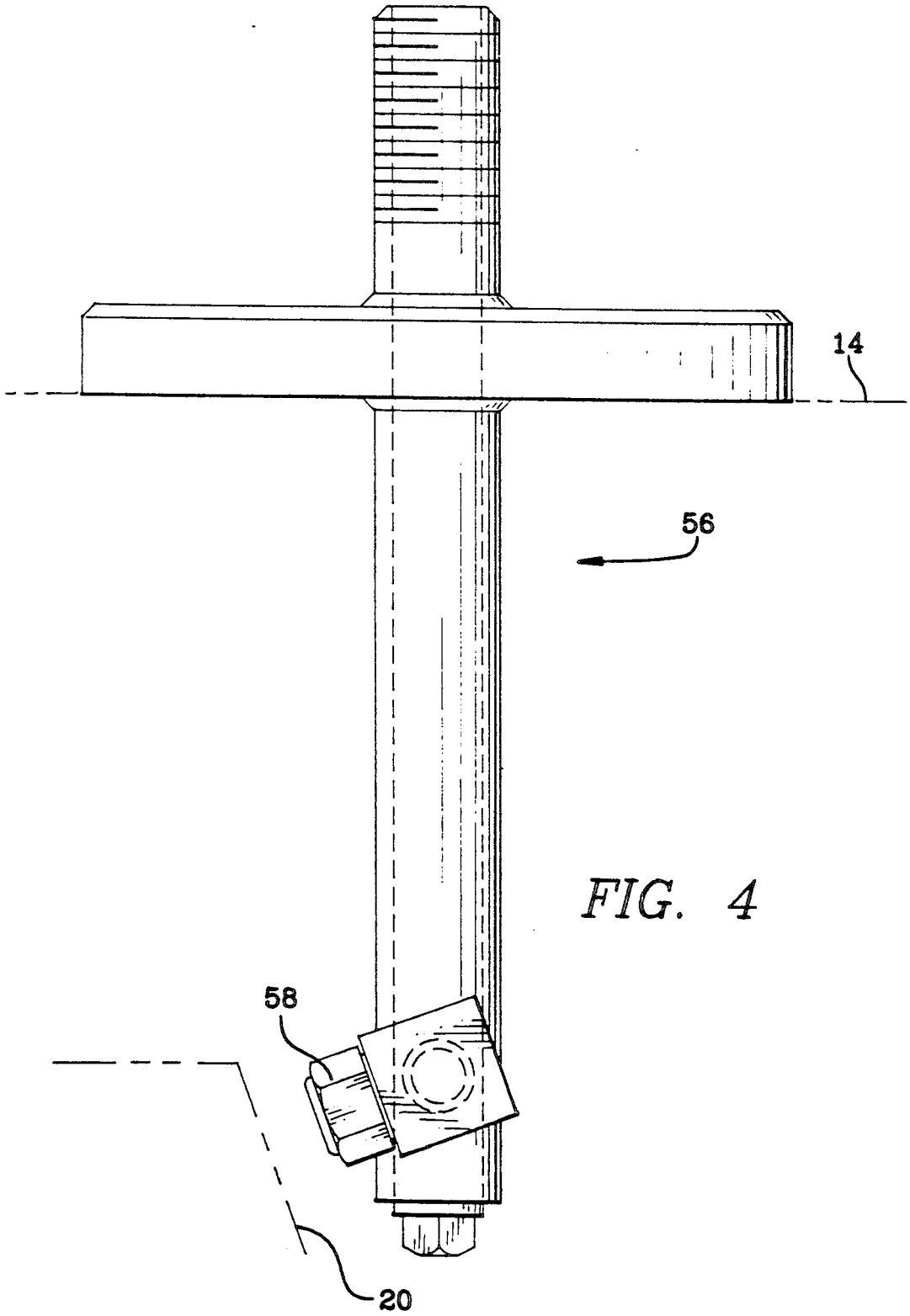
FIG. 4 is an elevational view of the nozzle-bearing lance.

The sugar crystals at the top of the centrifuge basket 20, commonly, are very dry. In that the mixing liquid nozzles 28 may not sufficiently wet the crystals, to produce an acceptable magma, a pre-wetting, nozzle-bearing lance 56 is provided; the same is shown in FIG. 1, projecting from the top of the centrifuge 10, and in FIG. 4 in greatly enlarged depiction. Lance 56 sprays water onto the centrifuging sugar crystals, at a rate of from approximately one-tenth to two-tenths of a gallon per minute. The nozzle 58 of the lance 56 is so directed as to emit the water substantially perpendicular to the basket 20 and, as shown, in immediate adjacency to the top of the basket.

While I have described my invention in connection with a specific embodiment thereof it is to be clearly understood that this is down only by way of example, and not as a limitation to the scope of the invention as set forth in the objects thereof and in the appended claims.

I claim:

1. A centrifuge comprising means for producing a high brix sugar liquid, which centrifuge has a magma mixing ring, said means comprising:

first means, for disposition thereof (a) below the mixing ring of the centrifuge, and (b) external of and circumjacent the rotating basket of the centrifuge, for receiving therein magma from said ring;

second means, coupled to said first means, for (a) agitating the magma received from said ring, and (b) melting sugar crystals, in the received magma, to a high brix sugar liquid;

third means, coupled to said first means, for receiving therein such high brix sugar liquid from said first means; and means for discharging the sugar liquid from said third means.

2. A centrifuge comprising means for producing a high brix sugar liquid, according to claim 1, wherein:

said first means comprises an annular compartment for receiving the magma;

said second means comprises means for setting the magma, received in said annular compartment, into a circular motion within said compartment.

3. A centrifuge comprising means for producing a high brix sugar liquid, according to claim 2, wherein:

said motion-setting means comprises a plurality of eductors, and means for introducing hot water into said eductors of said plurality thereof.

4. A centrifuge comprising means for producing a high brix sugar liquid, according to claim 3, wherein:

said eductors, of said plurality thereof, each have apertures formed therein through which to admit magma from said annular compartment.

5. A centrifuge comprising means for producing a high brix sugar liquid, according to claim 3, wherein:

said annular compartment has an outermost, circumferential wall, and said eductors are disposed within said compartment to direct hot water therefrom toward said wall.

6. A centrifuge comprising means for producing a high brix sugar liquid, according to claim 2, wherein:

said third means comprises a second annular compartment, joined to said magma-receiving compartment;

both of said compartments have a common wall, over which wall such high brix sugar liquid, produced from melted sugar crystals, can flow into said second compartment.

7. High brix sugar liquid producing means, according to claim 6, wherein:

said sugar liquid discharging means comprises a sub-compartment, which opens onto said second annular compartment, and a depending discharge pipe which opens onto said sub-compartment.

8. A centrifuge comprising means for producing a high brix sugar liquid, according to claim 1, further including:

means for disposition thereof between the rotating basket of the centrifuge and the magma mixing ring thereof for introducing a mixing liquid to sugar crystals which pass between said basket and said ring.

9. A centrifuge comprising means for producing a high brix sugar liquid, according to claim 8, wherein:

said mixing liquid introducing means comprises spray nozzles.

10. A centrifuge comprising means for producing a high brix sugar liquid, according to claim 1, further including:

means for mounting thereof in adjacency to an uppermost portion of the rotating basket of the centrifuge for introducing a wetting medium to sugar crystals in said uppermost portion of said basket.

11. A centrifuge comprising means for producing a high brix sugar liquid, according to claim 10, wherein:

said wetting medium introducing means comprises a nozzle-bearing lance.

12. A centrifuge comprising means for producing a high brix sugar liquid, which centrifuge has a magma mixing ring, said means comprising:

first means, for disposition thereof (a) below the mixing ring of the centrifuge, and (b) external of and circumjacent the rotating basket of the centrifuge, for receiving therein magma from said ring;

second means, coupled to said first means, for (a) agitating the magma received from said ring, and (b) melting sugar crystals, in the received magma, to a high brix sugar liquid;

third means, coupled to said first means, for receiving therein such high brix sugar liquid from said first means; and means for discharging the sugar liquid from said third means; wherein said first means comprises an annular compartment for receiving the magma;

said second means comprises means for setting the magma, received in said annular compartment, into a circular motion within said compartment;

said third means comprises a second annular compartment, joined to said magma-receiving compartment;

both of said compartments have a common wall, over which wall such high brix sugar liquid, produced from melted sugar crystals, can flow into said second compartment;

said sugar liquid discharging means comprises a sub-compartment, which opens onto said second annular compartment, and a depending discharge pipe which opens onto said sub-compartment; and said discharging means further comprises means interposed between said sub-compartment and said second annular compartment for slowing a discharge of the sugar liquid from said second annular compartment to said sub-compartment.

13. A centrifuge comprising means for producing a high brix sugar liquid, according to claim 12, wherein:

said discharge slowing means comprises a weir.

* * * * *